US008919021B2

(12) United States Patent
Pietrzyk et al.

(10) Patent No.: US 8,919,021 B2
(45) Date of Patent: Dec. 30, 2014

(54) METHOD AND APPARATUS FOR STRIPPING AND FEEDING CARTRIDGES

(71) Applicant: O.F. Mossberg & Sons, Inc., North Haven, CT (US)

(72) Inventors: Slawomir Pietrzyk, Meriden, CT (US); William Lutton, Winsted, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 0 days.

(21) Appl. No.: 14/014,884

(22) Filed: Aug. 30, 2013

(65) Prior Publication Data

US 2014/0068986 A1 Mar. 13, 2014

Related U.S. Application Data

(60) Provisional application No. 61/694,942, filed on Aug. 30, 2012.

(51) Int. Cl.

| | |
|---|---|
| ***F41A 9/61*** | (2006.01) |
| ***F41A 9/69*** | (2006.01) |
| ***F41A 9/17*** | (2006.01) |
| ***F41A 9/41*** | (2006.01) |

(52) U.S. Cl.

CPC ... *F41A 9/69* (2013.01); *F41A 9/17* (2013.01); *F41A 9/41* (2013.01)

USPC ..... 42/6; 42/50

(58) Field of Classification Search

CPC ..... F41A 9/69; F41A 9/17; F41A 9/41

USPC ..... 42/6, 50, 16

See application file for complete search history.

(56) References Cited

U.S. PATENT DOCUMENTS

| | | | | |
|---|---|---|---|---|
| 2,619,876 | A | 12/1952 | Olson | |
| 3,345,771 | A * | 10/1967 | Silsby | 42/18 |
| 3,672,089 | A * | 6/1972 | Silsby | 42/50 |
| 3,952,441 | A * | 4/1976 | Tant | 42/50 |
| 4,579,034 | A | 4/1986 | Holloway | |
| 5,520,019 | A * | 5/1996 | Schuetz | 42/49.02 |
| 5,765,302 | A | 6/1998 | Brandl et al. | |
| 8,096,074 | B2 * | 1/2012 | Robinson et al. | 42/16 |
| 8,479,635 | B2 * | 7/2013 | Overstreet et al. | 89/181 |
| 2004/0200110 | A1 * | 10/2004 | Greenhut | 42/18 |
| 2013/0055611 | A1 * | 3/2013 | Blazek | 42/50 |

FOREIGN PATENT DOCUMENTS

| | | |
|---|---|---|
| GB | 485560 | 5/1938 |

* cited by examiner

*Primary Examiner* — Michelle R Clement

(74) *Attorney, Agent, or Firm* — Donald S. Holland, Esq.; Holland & Bonzagni, P.C.

(57) ABSTRACT

Applicant has disclosed a Method and Apparatus for stripping and feeding cartridges to enhance stripping cartridges out of a detachable double-stacked magazine, inserted into a (well opening of a) receiver of a bolt-action rifle, and to enhance feeding the cartridges into the firing chamber. In the preferred "apparatus" embodiment, Applicant's device comprises two protrusions ("bumps") integral with, and radially spaced around, a bottom of the breech bolt head. When the rifle's breech bolt is pushed through the receiver, towards the firing chamber, a flat front face of a protrusion engages the rim of the top cartridge, pushing the cartridge out of the magazine, over the feed ramp or lip, and towards a firing chamber of the rifle. The protrusions alternate as to which engages the next top cartridge(s), due to the staggered (zigzag) columns of the cartridges in a double-stacked magazine.

6 Claims, 8 Drawing Sheets

METHOD AND APPARATUS FOR STRIPPING AND FEEDING CARTRIDGES

RELATED APPLICATION

This application claims priority to U.S. Provisional Patent Application, Ser. No. 61/694,942, filed Aug. 30, 2012, entitled "Device for Stripping and Feeding Cartridges." Applicant claims priority from that application. Applicant also incorporates by reference that application in its entirety.

FIELD OF INVENTION

This invention relates generally to bolt-action rifles. More specifically, it relates to devices for stripping cartridges from detachable magazines into a bolt-action rifle.

BACKGROUND OF INVENTION

Cartridges (also known as rounds) for firearms are elongated. A typical cartridge includes a shell casing, made of brass, which is filled with an explosive propellant. At its rear or closed end, the casing has a rim or flange containing a primer. Next to the rim is an extractor groove, an annular groove machined into the casing which provides a grip for the gun's extractor to pull the fired or unfired casing from the chamber of the firearm. The front and opposite end of the casing is open. A bullet, projectile, or head, usually of lead (optionally jacketed) is partially inserted into the open or front end of the case by crimping the casing onto the bullet.

Some rifles have internally fixed magazines for feeding cartridges into a chamber. For example, U.S. Pat. No. 2,619,876 to Olson discloses a "magazine rifle" with an internal magazine.

Other rifles, such as the AR-15 semi-automatic rifle, use detachable magazines instead to feed cartridges. Those magazines are slid upwardly into well openings of receivers and removably latched in place.

Detachable magazines usually are elongated containers, generally rectangular in cross-section, which are attached to the underside of the rifle (i.e., inside a well opening of the receiver). Such magazines are commonly made of aluminum alloys, plastic, steel, or a combination.

Detachable magazines are usually closed on four sides (except for latch holes), closed on the bottom, and open on an upwardly facing top. The open top has a rectangular opening and includes two retaining members, known as feed lips, which project into or partly close the opening from opposite sides. An internal spring urges a follower or lifter (i.e., a shaped piece of plastic or metal) toward the open side. The spring-loaded follower in turn urges the rounds as a group up against the lips. The lips act as a stop for the rounds so that they are not expelled from the magazine.

Rounds are stacked or oriented in the detachable magazine such that the longitudinal axes of the rounds are substantially parallel and perpendicular to the direction of travel of the spring and follower. Adjoining rounds are oriented side-by-side and in the same direction, i.e., the bullets of adjacent rounds are next to each other, as are the cases.

The rounds are usually stacked in the magazine, either in a single straight column or in a staggered (zigzag) column (also called double-stacked or high-capacity) fashion. Double-stacked magazines contain two side-by-side staggered columns offset by approximately half of the diameter of a round. The double-stacked magazines, being wider, have a higher round capacity compared to single-column magazines of the same overall length.

As the firearm cycles, cartridges are moved to the top of the magazine by a follower driven by spring compression to either a single feed position or side-by-side feed positions. In the double-stacked magazines, the position of the next top round is staggered to the left or right.

At the top of such magazines, the feed lips alternately retain the left and right top-most round, as the rounds are fed up and picked off. The top-most round is held in place by only one of the lips. Hereafter the term "magazine" will mean magazines where the lips alternately retain the top-most round.

Prior to use, a firearm magazine must be loaded, charged, or filled with rounds. When a magazine is being loaded, it is necessary to depress all previously loaded rounds to provide vacant space below the lips so an additional round can be inserted or loaded into this space. Each time another round is loaded the spring is further compressed, requiring more insertion force.

When a magazine is fully loaded, the spring is fully compressed and exerts maximum upward force against the follower and rounds towards the lips. Sometimes though a spring is weakened. That can hinder stripping the rounds.

Accordingly, it is a primary object of the present invention to provide a mechanical device to help strip a cartridge off a detachable double-stacked magazine.

It is another object to provide a cartridge stripping device, integrally attached to the breech bolt head, which cooperates with existing double-stacked magazines.

It is another object to provide a cartridge stripping device, commensurate with the above-listed objects, which is durable to use.

SUMMARY OF INVENTION

Applicant has disclosed a method and apparatus ("Cartridge Stripper") to enhance stripping cartridges from a detachable double-stacked magazine for feeding the cartridges into the chamber of a bolt-action rifle. In the preferred "apparatus" embodiment, the invention comprises a pair of protrusions ("bumps") integral with, and radially spaced around, a bottom of the breech bolt head. When the rifle's breech bolt is pushed forward, a flat front face of a protrusion engages the rim of the top cartridge to be fed into a feed chamber, pushing the cartridge out of the magazine, over the feed ramp or lip, and towards the feed chamber of the receiver. The protrusions alternate as to which engages the next top cartridge, due to the staggered (zigzag) locations of the cartridges in a double-stacked magazine.

BRIEF DESCRIPTION OF DRAWINGS

The above and other objects and advantages of the present invention will become more readily apparent upon reading the following description and drawings in which:

FIG. 2 depicts;

FIG. 2 depicts;

FIG. 2 depicts;

DETAILED DESCRIPTION OF PREFERRED EMBODIMENT(S)

Figure 1:
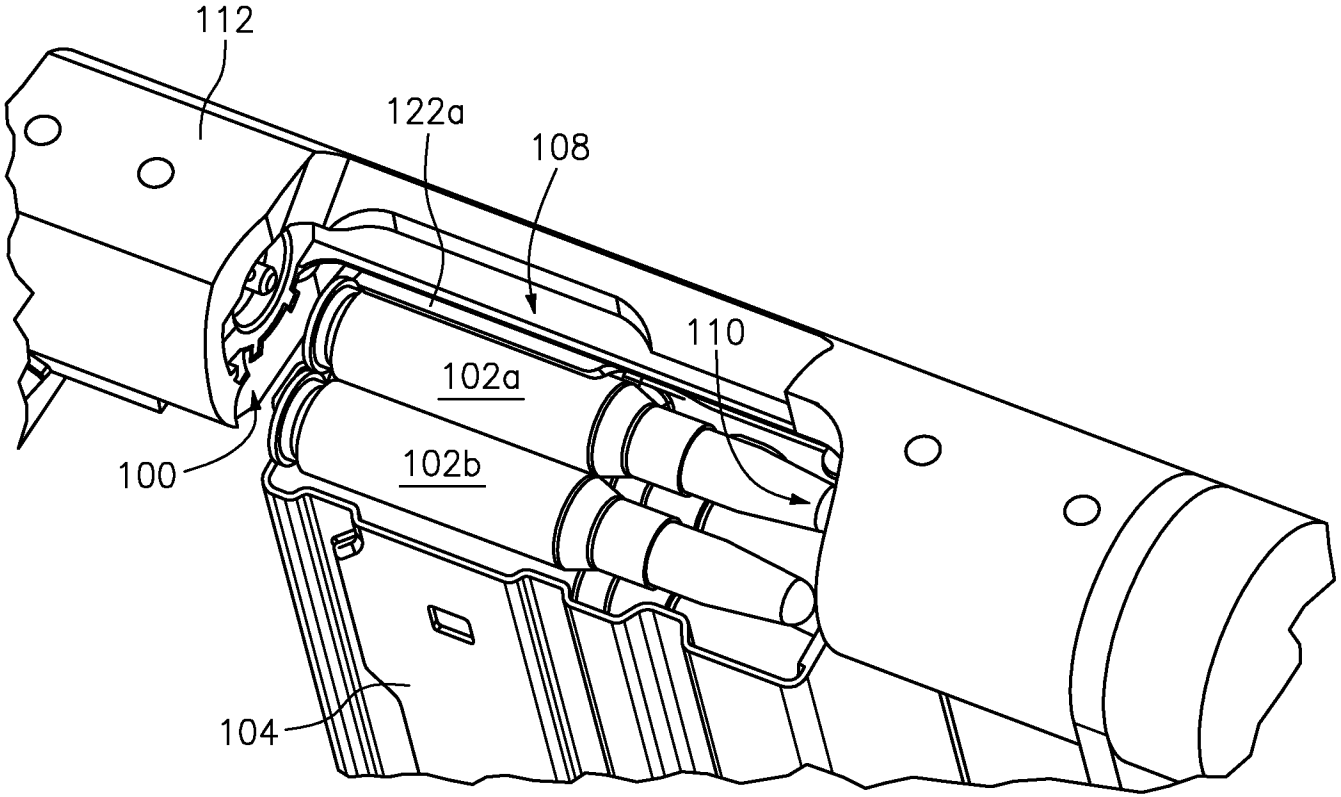
FIG. 1 is a partial view of a bolt-action rifle, with portions broken away, to show Applicant's preferred Cartridge Stripper adjacent a loaded double-stacked magazine attached to the underside of a bolt-action rifle.
Figure 2:
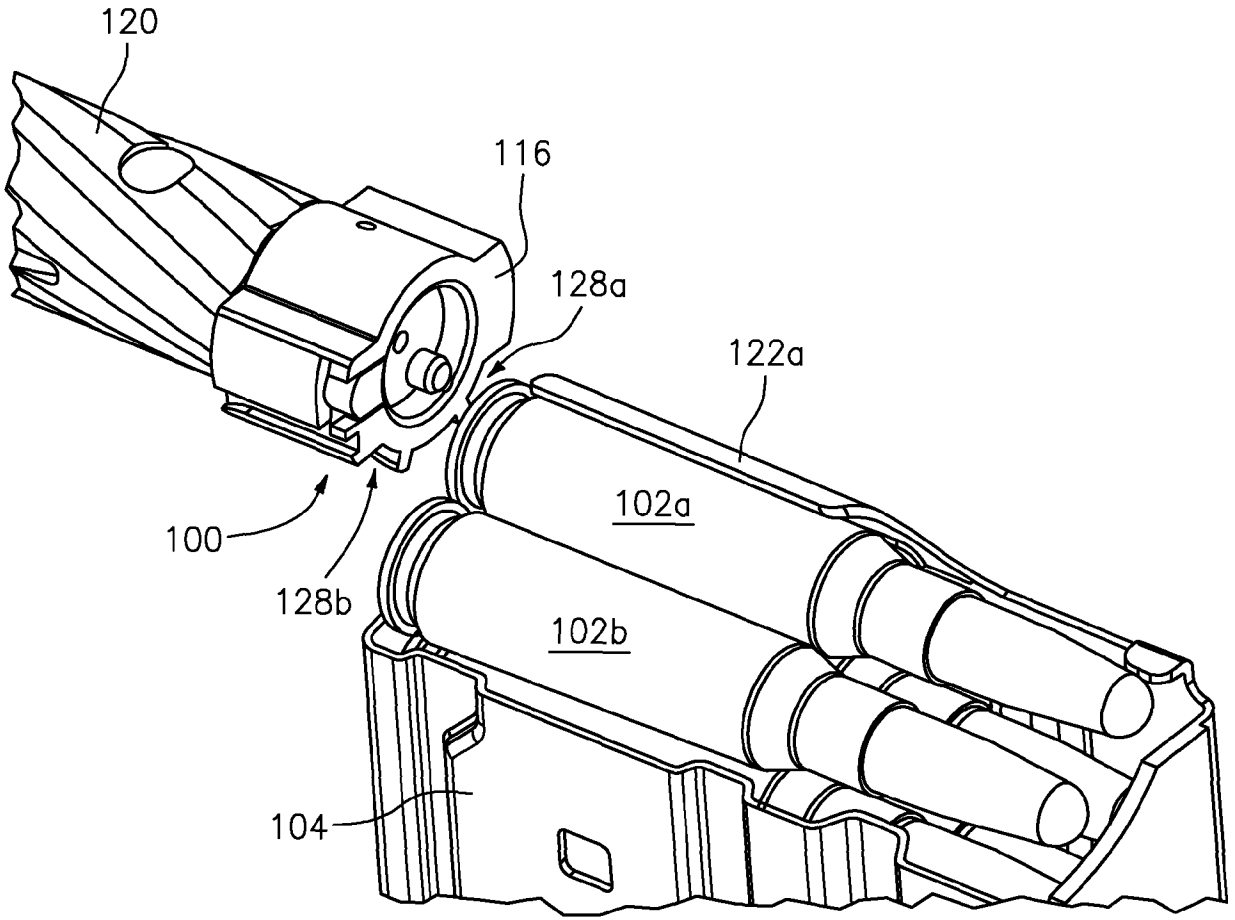
FIG. 2 is a perspective view of just Applicant's preferred Cartridge Stripper initially engaging the next cartridge in the magazine.

Referring to FIGS. 1-8 in detail, Applicant has disclosed a "Cartridge Stripper" device 100 to enhance stripping cartridges (e.g., 102*a*, 102*b*) out of a detachable double-stacked magazine 104, inserted into (a well opening 106 of and attached to) a receiver 108, and to enhance feeding the cartridges into the firing chamber 110 of a bolt-action rifle 112. O.F. Mossberg & Sons, Inc. ("Mossberg") is the Assignee of this invention.

The preferred Cartridge Stripper 100 comprises a pair of protrusions or bumps (a.k.a. first and second protrusions) 114*a*, 114*b* integral with, and radially spaced around, a bottom portion of a breech bolt head 116. The protrusions 114*a*, 114*b* are arranged so that depending upon the staggered location of the top cartridge in the double-stacked magazine 104, one or the other protrusion will catch the next or top shell.

Figure 3:
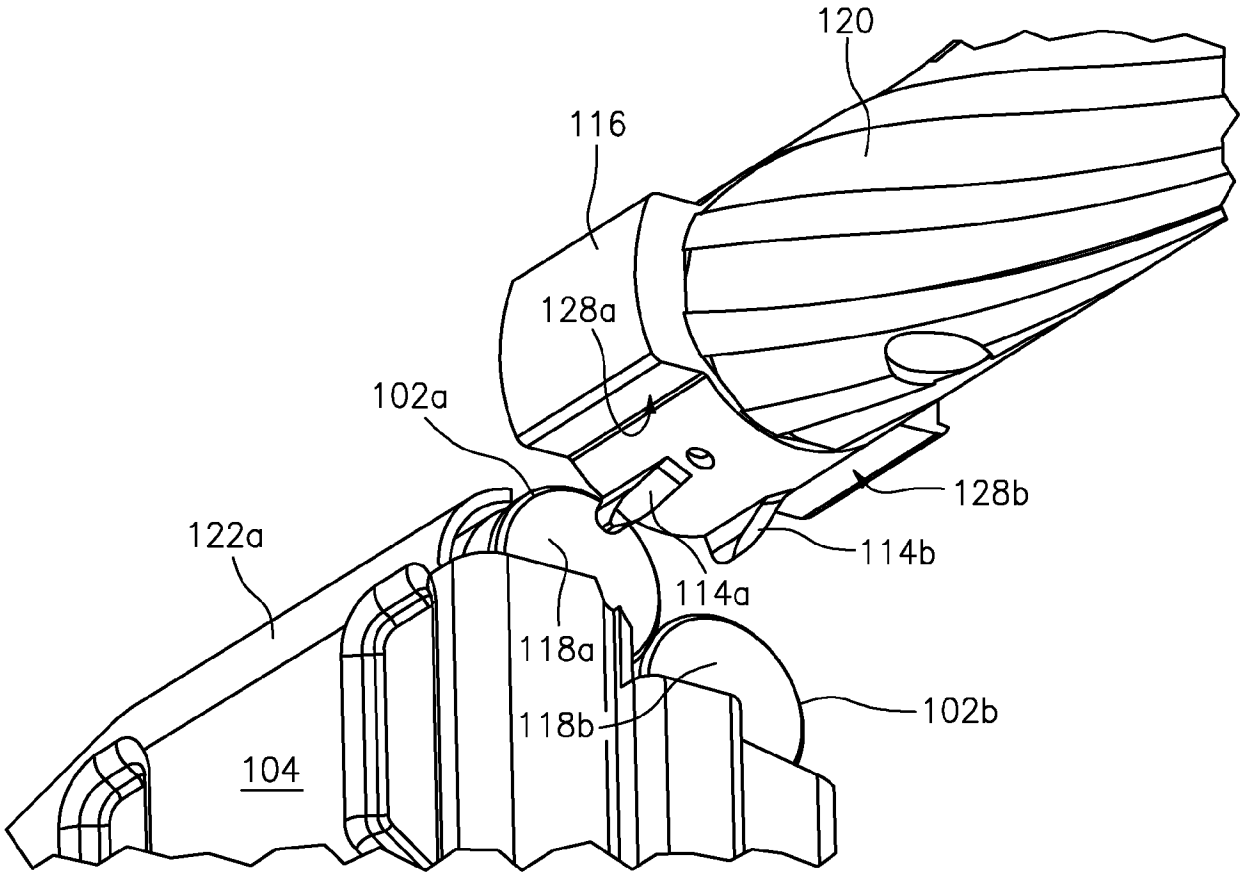
FIG. 3 is a bottom perspective view of what
Figure 4:
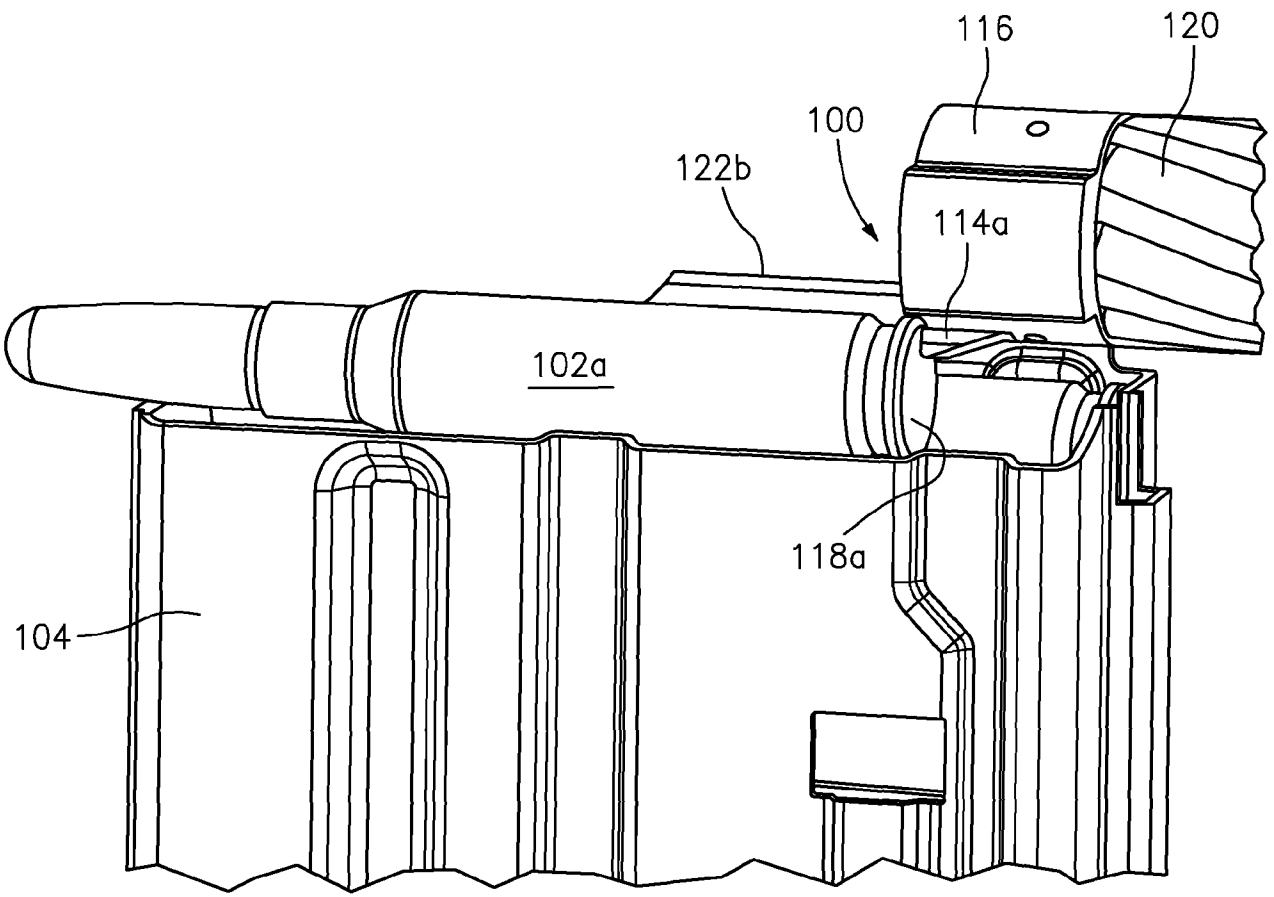
FIG. 4 is a side view of what
Figure 5:
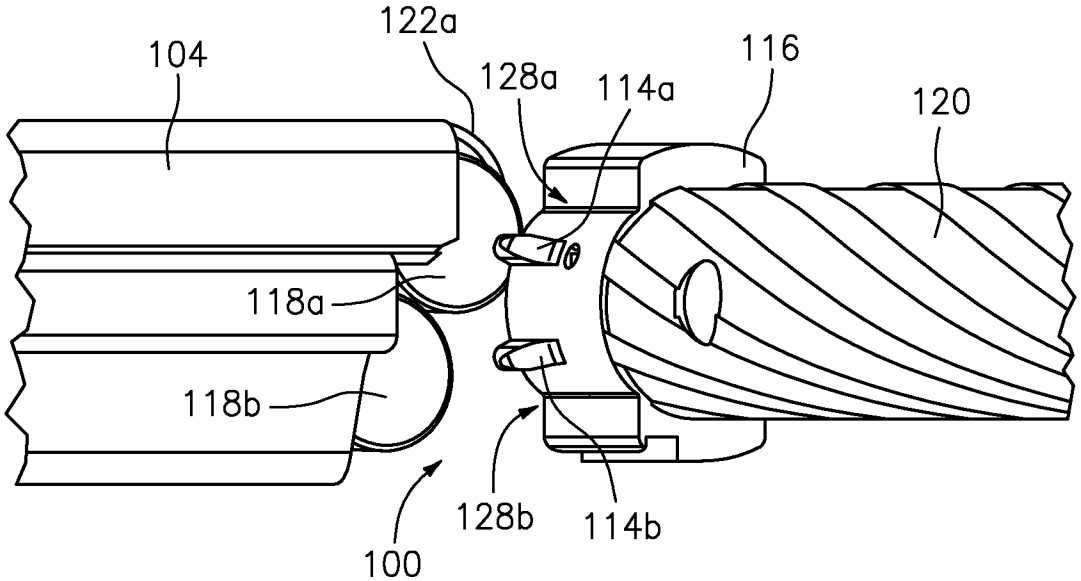
FIG. 5 is a bottom view what
Figure 6:
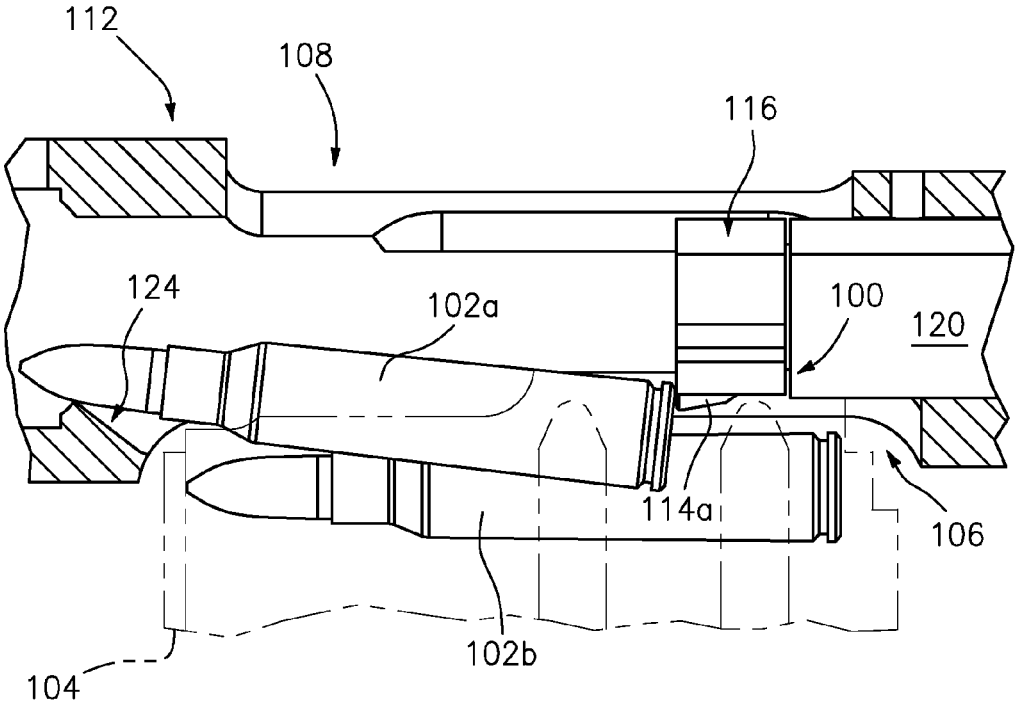
FIG. 6 depicts the preferred Cartridge Stripper while a cartridge is being stripped from the magazine and fed into the rifle's receiver.
Figure 7:
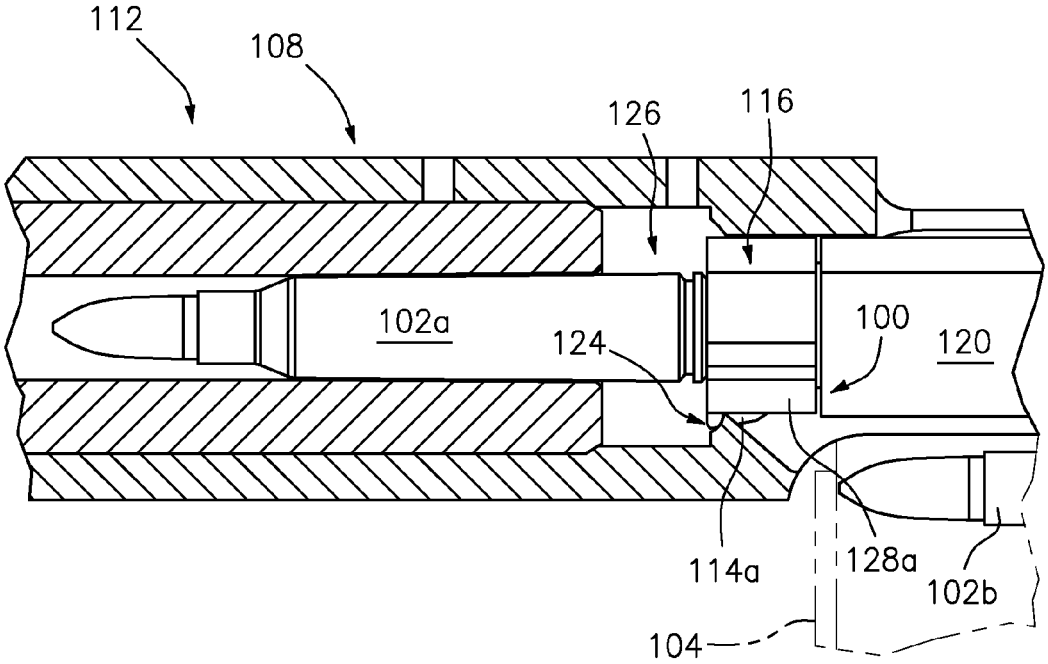
FIG. 7 depicts the position of the Cartridge Pusher after the cartridge has been stripped and fed into the receiver.
Figure 8:
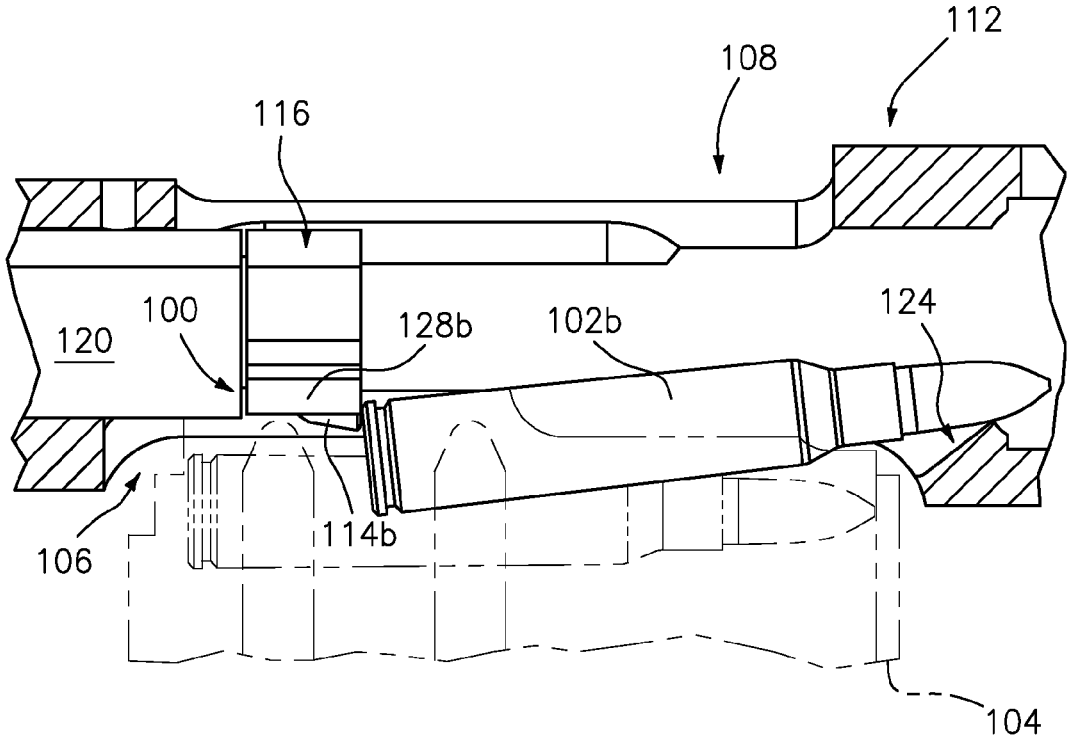
FIG. 8 depicts the preferred Cartridge Stripper, from an opposite side, while another cartridge is being stripped from the magazine and fed into the rifle's receiver.
Figure 9:
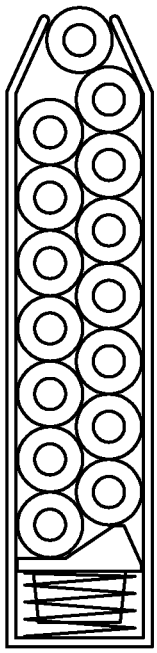
FIG. 9 (PRIOR ART)
FIG. 9 labeled "Prior Art", is a plan view of a detachable double-stacked magazine with stored cartridges and an end of the magazine removed to expose the inside.

In FIGS. 3-5, the illustrated top cartridge is 102*a*. The first protrusion 114*a* on bolt head 116 is positioned to coincide with the rim 118*a* of the top cartridge (here, 102*a*) to be fed into the firing chamber 110 of the receiver 108.

When the rifle's breech bolt 120 is pushed forward into the receiver 108, a flat front face of protrusion 114*a* on the Cartridge Stripper 100 (as well as the breech bolt head 116) engages the rim 118*a* of the next cartridge 102*a* to be fed into the firing chamber 110. The position of cartridge 102*a* is, at that stage, offset from the illustrated position of the next cartridge 102*b* by approximately one-half round. See FIGS. 4 and 5.

As the breech bolt 120 is pushed though the receiver 108, the protrusion 114*a* helps the breech bolt head 116: strip the cartridge 102*a* out of the magazine's feed or retaining lips 122*a*, 122*b*; and push the cartridge 102*a*, over the receiver's feed ramp 124, towards the chamber 110. The breech bolt head 116 then finishes seating the cartridge 102*a* into a locking area 126 of the receiver 108. See FIGS. 6-7.

Bolt head 116 has two side notches 128*a*, 128*b*. The notches permit the bolt head 116 to ride over the magazine's two lips 122*a*, 122*b*, when the bolt head 116 moves forward or backwards (opening the action).

After breech bolt 120 has been returned through the receiver to open the action, the top round becomes cartridge 102*b*. When the bolt head 116 is pushed through the receiver 108 again, towards the chamber 110, the other protrusion 114*b* engages the rim 118*b* of cartridge 102*b* to help push the cartridge 102*b* out of the magazine 104 and over the receiver's feed ramp 124. See FIG. 8.

The protrusions 114*a*, 114*b* act as an extension of the breech bolt head 116, down into the magazine 104, to provide reliable stripping and feeding of the cartridges (e.g., 102*a*, 102*b*) contained in the magazine. Yet the protrusions 114*a*, 114*b* do not interfere with the breech bolt 116 passing through the receiver 108.

Since the protrusions 114*a*, 114*b* are integral with (and stationary relative to) the breech bolt head 116, there are no moving parts added to the rifle. This helps make the Cartridge Stripper dependable and durable because the stripper does not add any moving parts.

Applicant's invention can be thought of as a method comprising:

a. inserting a detachable double-stacked magazine, with staggered stored cartridges, into a magazine well opening of a receiver of a bolt-action rifle, wherein:
   i. the magazine has four substantially closed sides, a closed bottom, and an open top;
   ii. the open top has a rectangular opening and includes two feed lips, which project into the rectangular opening;
   iii. the magazine has an internal spring which urges a follower toward the open top;
   iv. the spring and follower urge the staggered cartridges as a group up against the feed lips, wherein longitudinal axes of the cartridges are substantially parallel and perpendicular to a sole direction of travel of the spring and follower; and
   v. the feed lips act as stops for the cartridges so that they are not expelled from the magazine;
b. attaching the inserted double-stacked magazine to the receiver;
c. moving a breech bolt of the rifle forward, in and through the receiver, to load a top cartridge from the double-stacked magazine into a firing chamber of the rifle;
   i. upon the breech bolt moving forward in the receiver, engaging a rim of the top cartridge in the double-stacked magazine by a first protrusion, integral with and extending outwardly from a bottom of a breech bolt head, adjacent feed lips of the inserted magazine;
d. moving the breech bolt backwards, away from the chamber, through the receiver; and
e. moving the breech bolt forward again, in and through the receiver, to load a next top cartridge from the double-stacked magazine into the firing chamber;
   i. upon the breech bolt moving forward again in the receiver, engaging a rim of a next top cartridge in the magazine by a second protrusion, integral with and extending outwardly from a bottom of a breech bolt head of the rifle, adjacent feed lips of the inserted magazine, wherein the second protrusion is radially spaced apart from the first protrusion on the breech bolt head.

The means of attaching the detachable double-stacked magazine to the receiver forms no part of this invention. The attachment can be by any standard latching system (not shown). Such latching systems have a spring-loaded latch, attached to the receiver, and a corresponding latch hole in a side of the magazine.

It should be understood by those skilled in the art that obvious structural modifications can be made to the invention, without departing from the spirit of the invention. Accordingly, reference should be made primarily to the following claims rather than the foregoing specification to understand the scope of the invention.

We claim:

1. A method comprising:

a. inserting only a detachable double-stacked magazine, with staggered stored cartridges, into a magazine well opening of a receiver of a bolt-action rifle, wherein:
   i. the magazine has four substantially closed sides, a closed bottom and an open top;
   ii. the open to has a rectangular opening and includes two feed lips, which project into the rectangular opening;

iii. the magazine has an internal spring which urges a follower, without any moving parts, toward the open top;

iv. the spring and follower urge all of the staggered cartridges as a group up against the feed lips without the assistance of any additional device, inside the magazine, moving any of the cartridges toward the top, wherein longitudinal axes of the cartridges are substantially parallel to a direction of travel of the follower; and v. the feed lips act as stos for the cartridges so that they are not expelled from the magazine;

b. attaching the inserted magazine to the receiver;

c. moving a breech bolt of the rifle forward, in and through the receiver, to load a top cartridge from the double-stacked magazine into a firing chamber of the rifle;

i. upon the breech bolt moving forward in the receiver, engaging a rim of the top cartridge in the double-stacked magazine by a first protrusion, integral with and extending outwardly from a bottom of a breech bolt head, adjacent feed lips of the inserted magazine;

d. moving the breech bolt backwards, away from the chamber, through the receiver; and e. moving the breech bolt forward again, in and through the receiver, to load a next top cartridge from the double-stacked magazine into the firing chamber;

i. upon the breech bolt moving forward again in the receiver, engaging a rim of a next top cartridge in the magazine by a second protrusion integral with and extending outwardly from a bottom of a breech bolt head of the rifle, adjacent feed lips of the inserted magazine, wherein the second protrusion is radially spaced apart from the first protrusion on the breech head.

2. The method of claim 1 wherein the first protrusion and the second protrusion are always stationary relative to the breech bolt head.

3. The method of claim 2 wherein:

a. the first protrusion and the second protrusion act as extensions of the breech bolt head, down into the magazine, to provide reliable stripping and feeding of the cartridges contained in the magazine; and b. the first protrusion and the second protrusion do not interfere with the breech bolt head passing through the receiver.

4. An apparatus consisting of:

a. a double-stacked magazine, with staggered stored cartridges, attached within a well opening of a receiver of a bolt-action rifle; wherein:

i. the magazine has four substantially closed sides, a closed bottom, and an open top;

ii. the open top has a rectangular opening and includes two feed lips, which project into the rectangular opening;

iii. the magazine has an internal spring which urges a follower, which Has no moving parts, toward the open top;

iv. the spring and follower urges all of the staggered cartridges as a group up against the feed lips, without the assistance of any additional device inside the magazine, wherein longitudinal axes of the cartridges are substantially parallel to a direction of travel of the follower, and v. the feed lips act as stops for the cartridges so that they are not expelled from the magazine;

b. assistance means for assisting stripping the staggered cartridges from the double-stacked magazine and assisting feeding the cartridges into a chamber of the rifle, wherein the assistance means comprises:

i. a first protrusion and a second protrusion, radially spaced apart and extending outwardly from a bottom of a breech bolt head of the rifle, adjacent feed lips of the inserted magazine;

ii. wherein the first protrusion is designed to engage a rim of a top cartridge in the double-stacked magazine, during stripping of the cartridges from the magazine; and iii. wherein the second protrusion is designed to engage a rim of a next top cartridge in the double-stacked magazine, during stripping of the cartridges from the magazine.

5. The apparatus of claim 4 wherein the first protrusion and the second protrusion are integral with, and stationary relative to, the breech bolt head.

6. The apparatus of claim 4 wherein:

a. the first protrusion and the second protrusion act as extensions of the breech bolt head, down into the magazine, to provide reliable stripping and feeding of the cartridges contained in the magazine; and b. the first protrusion and the second protrusion do not interfere with the breech bolt head passing through the receiver.

* * * * *